US012221800B2

(12) United States Patent
Besancon

(10) Patent No.: US 12,221,800 B2
(45) Date of Patent: Feb. 11, 2025

(54) SELF-DEPLOYING BIVOUAC SACK

(71) Applicant: Jayson Besancon, Kent, WA (US)

(72) Inventor: Jayson Besancon, Kent, WA (US)

( * ) Notice: Subject to any disclaimer, the term of this patent is extended or adjusted under 35 U.S.C. 154(b) by 223 days.

(21) Appl. No.: 18/075,897

(22) Filed: Dec. 6, 2022

(65) Prior Publication Data

US 2023/0099445 A1 Mar. 30, 2023

Related U.S. Application Data

(63) Continuation-in-part of application No. 16/538,898, filed on Aug. 13, 2019, now abandoned.

(51) Int. Cl.

| | |
|---|---|
| ***E04H 15/02*** | (2006.01) |
| ***A45F 3/52*** | (2006.01) |
| ***A47C 29/00*** | (2006.01) |
| ***A47G 9/08*** | (2006.01) |
| ***E04H 15/32*** | (2006.01) |
| ***E04H 15/40*** | (2006.01) |

(52) U.S. Cl.

CPC ..... *E04H 15/02* (2013.01); *A45F 3/52* (2013.01); *A47C 29/006* (2013.01); *A47G 9/086* (2013.01); *E04H 15/324* (2013.01); *E04H 15/405* (2013.01)

(58) Field of Classification Search

CPC ..... E04H 15/02; E04H 15/324; E04H 15/405; A47C 29/003; A47C 29/006; A47G 9/08; A47G 9/086

See application file for complete search history.

(56) References Cited

U.S. PATENT DOCUMENTS 598,995 A * 2/1898 Jacob ..... A47G 9/08 5/413 R
983,223 A * 1/1911 Fitch ..... A47G 9/08 5/413 R (Continued)

FOREIGN PATENT DOCUMENTS

AT 5168 U1 * 4/2002
CN 112386071 A * 2/2021

(Continued)

*Primary Examiner* — David R Dunn
*Assistant Examiner* — Danielle Jackson
(74) *Attorney, Agent, or Firm* — Dean A. Craine, P.S.

(57) ABSTRACT

A portable bivouac sack configured to be self-deploy when released from its compact storage configuration. The bivouac sack comprises an elongated bag shell made of waterproof material with an elongated ground piece and a top panel. The sack is closed on one end, open at an opposite end, and configured to receive a sleeping bag. The top panel is shorter than the ground piece to form a transverse opening into the bag shell and a longitudinally aligned pan. Disposed over the pan is a self-deploying frame that folds into a compact circular configuration for storage and automatically unfolds and self-deploys when released to form an expanded frame. Attached to the frame is a flexible outer cover that expands with the frame to form a dome over the pan. The frame cover extends downward towards the pan and a sliding connector selective attaches the frame cover to the pan to provide egress and ingress to the protected area under the dome. An optional outer cover is provided that fits over the dome.

18 Claims, 8 Drawing Sheets

(56) References Cited

U.S. PATENT DOCUMENTS 1,699,002 A * 1/1929 Leibold ..... A47G 9/086 5/413 R
3,860,980 A * 1/1975 Ebert ..... A47G 9/086 5/413 R
4,232,692 A * 11/1980 Atkins ..... A47C 29/006 5/418
4,825,892 A * 5/1989 Norman ..... E04H 15/40 135/905
4,858,634 A * 8/1989 McLeese ..... E04H 15/40 135/905
5,458,146 A * 10/1995 Gregg ..... E04H 15/38 5/413 R
5,690,134 A * 11/1997 McCauley ..... A47G 9/062 135/900
5,740,565 A * 4/1998 McDade ..... A47C 27/081 5/413 R
5,881,405 A * 3/1999 Garrigues ..... A47G 9/086 5/413 R
5,941,264 A * 8/1999 Gregg ..... E04H 15/38 5/413 R
6,694,995 B1 * 2/2004 Ransom ..... A01M 31/025 135/901
6,986,178 B2 * 1/2006 Turner ..... E04H 15/38 5/413 R
7,438,078 B2 * 10/2008 Woodruff ..... A47G 9/086 135/96
D629,176 S * 12/2010 Abrams ..... D2/719
10,208,499 B2 * 2/2019 Lovell ..... E04H 15/405
2010/0154852 A1 * 6/2010 Trieu ..... A47G 9/086 493/405
2018/0042397 A1 * 2/2018 Brereton ..... A47C 29/003

FOREIGN PATENT DOCUMENTS

CN 112761411 A * 5/2021 ..... E04H 15/02
GB 2196359 A * 4/1988 ..... A47G 9/086
KR 200372581 Y1 * 1/2005
KR 200472516 Y1 * 5/2014

* cited by examiner

SELF-DEPLOYING BIVOUAC SACK

This continuation-in-part application is based on and claims the filing date benefit of the U.S. utility patent application (application Ser. No. 16/538,898) filed on Aug. 13, 2019.

BACKGROUND OF THE INVENTION

Field of the Invention

The present invention relates to the field of buildings and similar structures, including tents and canopies, more specifically, a tent combined with another device. (E04H15/02)

SUMMARY OF THE INVENTION

A lightweight, portable bivouac sack configured to be stored in a compact, storage configuration that automatically and quickly self-deploys and ready for use when released from its compact, folded configuration. The released bivouac sack can then be quickly and easily converted into a compact storage configuration.

The bivouac sack includes a bag shell configured to receive a sleeping bag. More specifically, the bag shell includes an elongated ground piece made of lightweight, waterproof material. A top cover made of similar material is integral or attached to the ground piece. The upper end of the top cover is detached, thereby creating an opening into the bag shell. A sleeping bag is inserted through the opening and into the bag shell during use. A section of the ground piece, hereinafter called a 'pan' extends longitudinally from the top cover.

The bivouac sack also includes a self-deploying, spring-like frame that extends upward from the pan. Attached to the frame is a flexible frame cover. The frame is configured to forcibly fold into a compact circular configuration for storage and automatically unfolds and self-deploys to form an expanded, self-supporting structure over the pan. The frame cover is sufficiently flexible to fold when the frame collapses and expands with the frame to form a dome over the pan. The size of the dome covers the entire pan and the opening into the bag shell. A sliding connector attaches the lower edges of the frame cover to the pan to hold the frame over the pan when expanded and to provide the user egress and ingress to the protected area under the dome.

In one embodiment, the frame cover includes a mesh panel and acts as bug shield. An optional outer cover that fits over the frame cover may be distributed with a frame cover.

These, together with additional objects, features, and advantages of the bivouac sack, will be readily apparent to those of ordinary skill in the art upon reading the following detailed description of the presently preferred but illustrative embodiments taken in conjunction with the accompanying drawings.

In this respect, before explaining the current embodiments of the bivouac sack in detail, it is to be understood that the bivouac sack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the waterproof bivouac sack.

Therefore, the claims must be regarded as including such equivalent construction insofar as they do not depart from the spirit and scope of the bivouac sack. It is also to be understood that the phraseology and terminology employed herein are for descriptive purposes and should not be regarded as limiting.

BRIEF DESCRIPTION OF DRAWINGS

The accompanying drawings, which are included to provide a further understanding of the invention, are incorporated in and constitute a part of this specification, illustrate an embodiment of the invention and, together with the description, explain the invention's principles. They are meant to be exemplary illustrations to enable persons skilled in the art to practice the disclosure. They are not intended to limit the scope of the appended claims.

DETAILED DESCRIPTION OF THE EMBODIMENT

The following detailed description is merely exemplary and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily construed as preferred or advantageous over other implementations. All of the implementations described below are exemplary implementations provided to enable persons skilled in the art to practice the disclosure and are mil intended to limit the scope of the appended claims. Furthermore, there is no intention to be bound by any expressed or implied theory presented in the preceding technical field, background, summary, or the following detailed description.

Detailed reference will now be made to one or more potential embodiments of the disclosure, illustrated in FIGS. 1 through 7C.

The bivouac sack 100 is a temporary shelter configured to automatically deploy when released from a stored configuration to create a protective, temporary sleeping structure.

Figure 1:
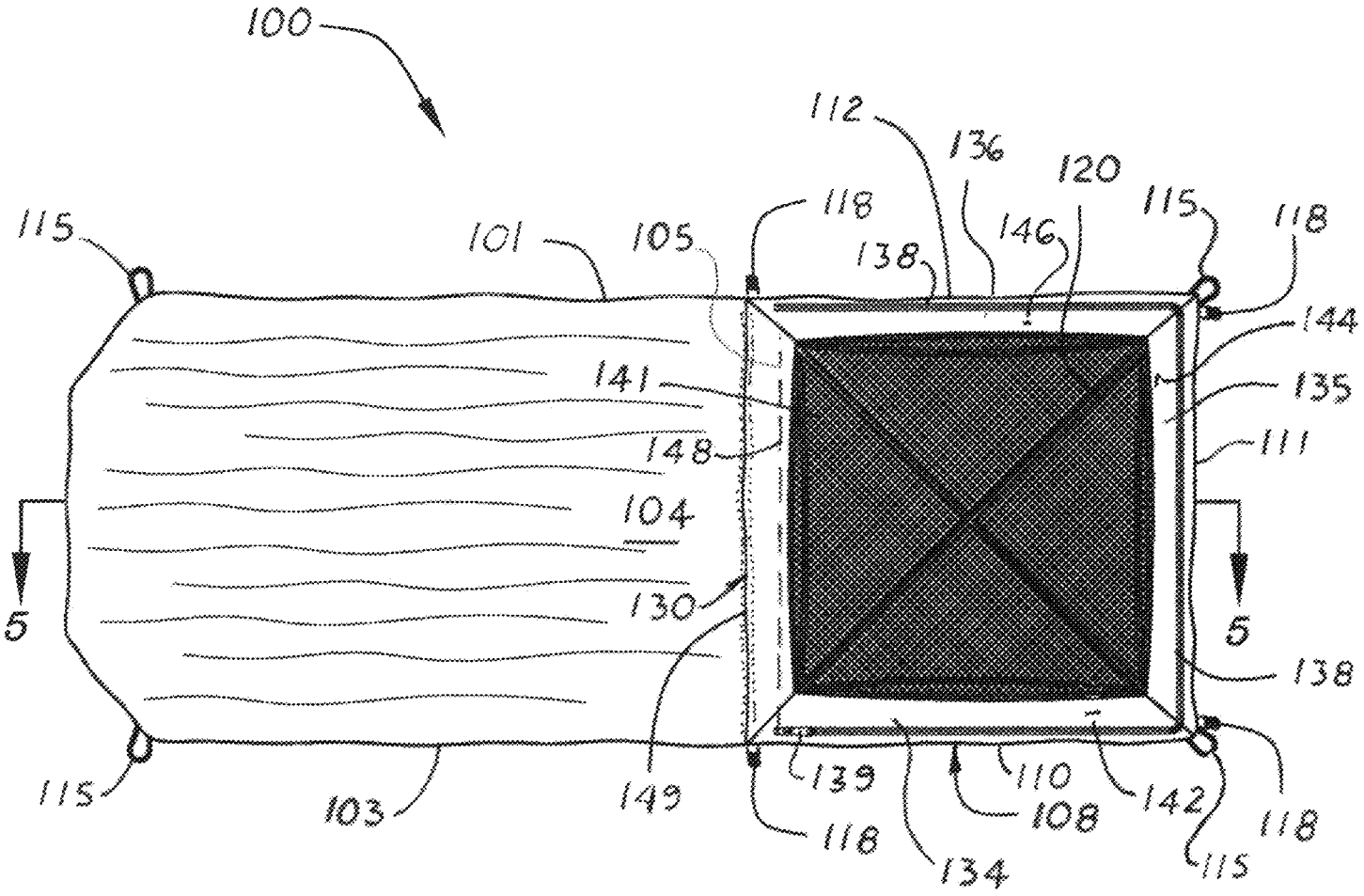
FIG. 1 is a top view of a deployed bivouac sack with a frame cover placed over the frame.
Figure 2:
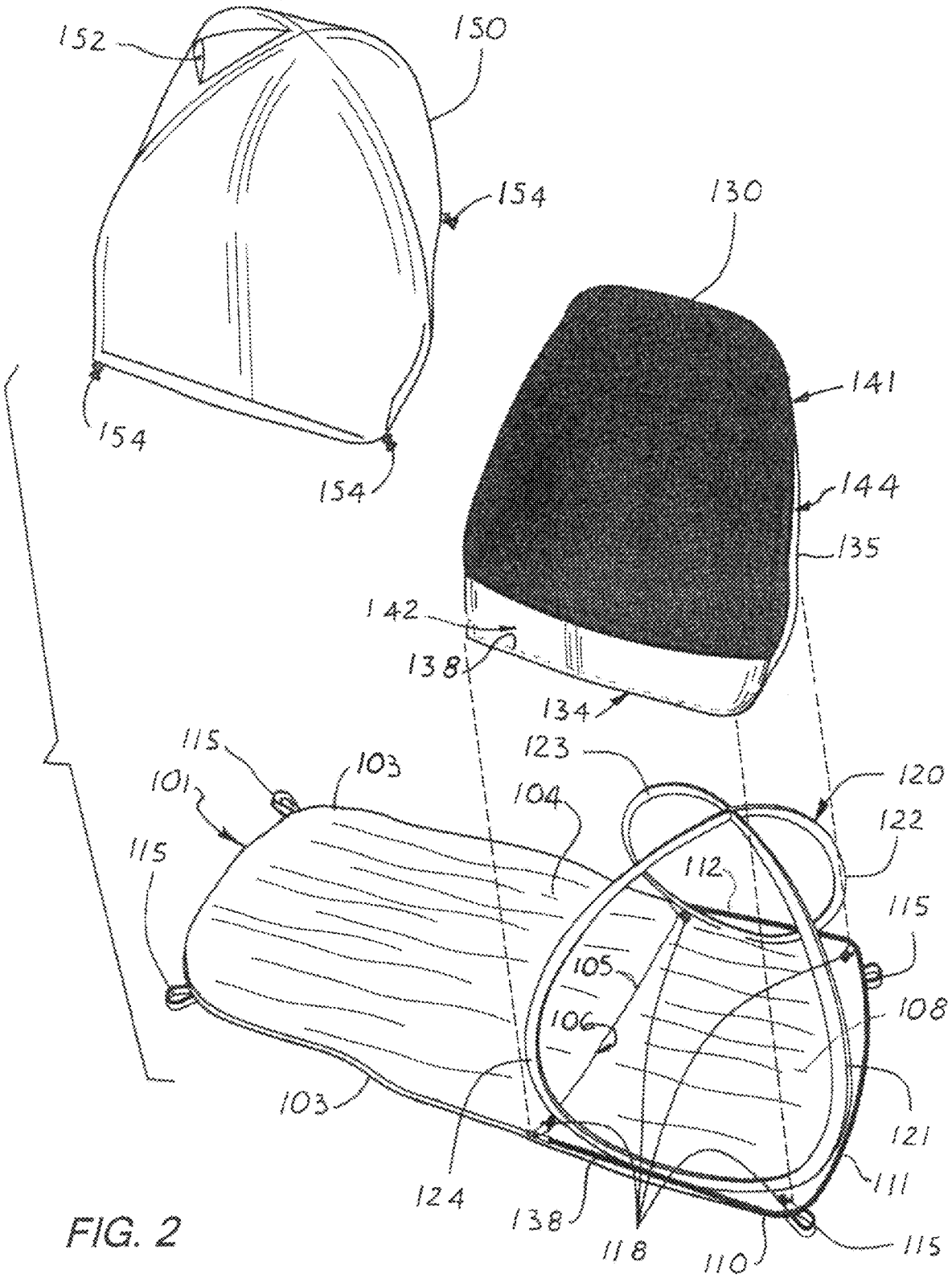
FIG. 2 is an exploded perspective view of the bivouac sack showing the self-deploying frame expanded over the pan, a frame cover disposed over the frame and detached from the bag shell and an optional outer cover ready to be placed over the frame cover.
Figure 3:
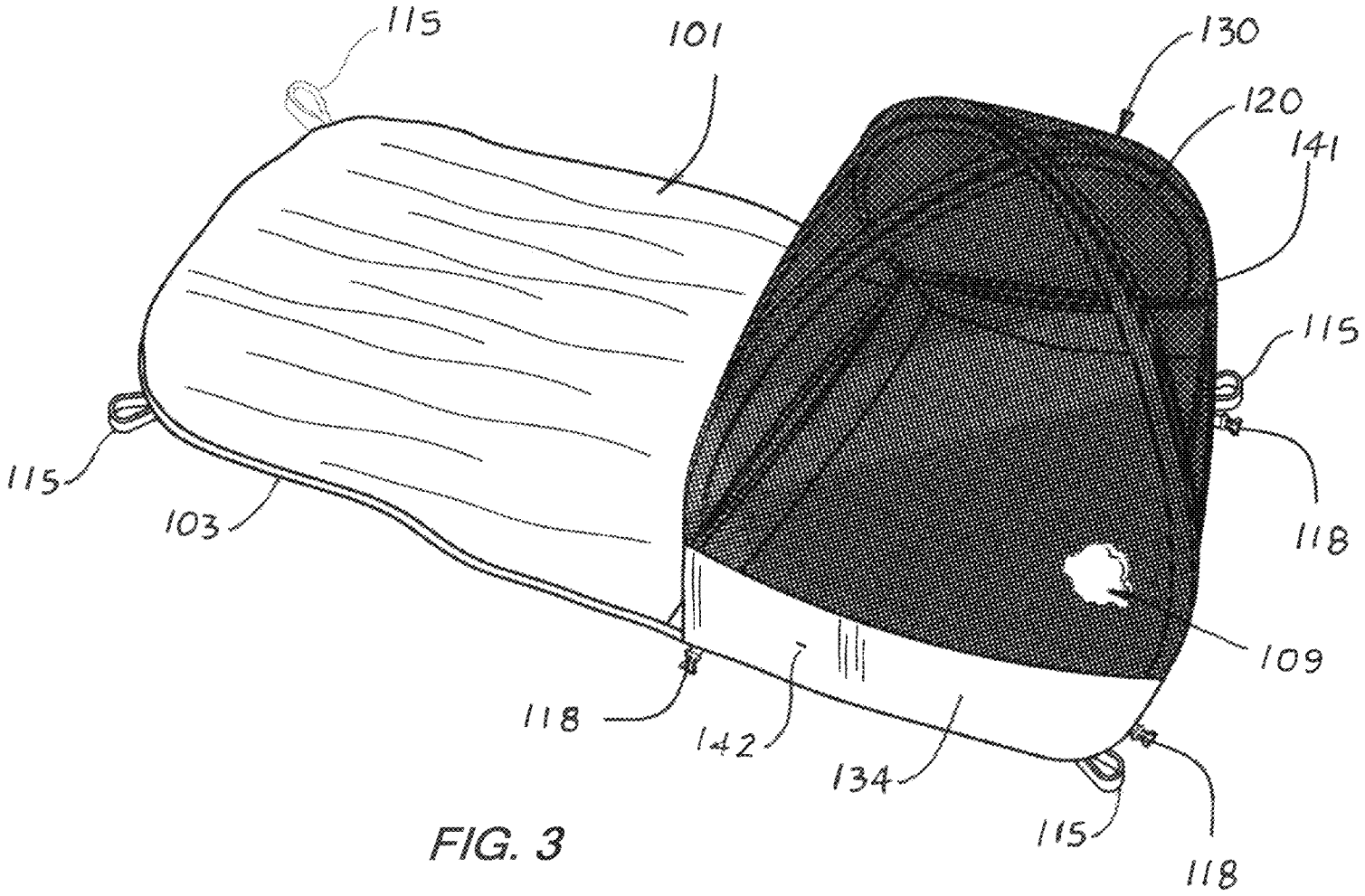
FIG. 3 is a perspective view of the bivouac sack with the frame cover disposed over the expanded frame.
Figure 5:
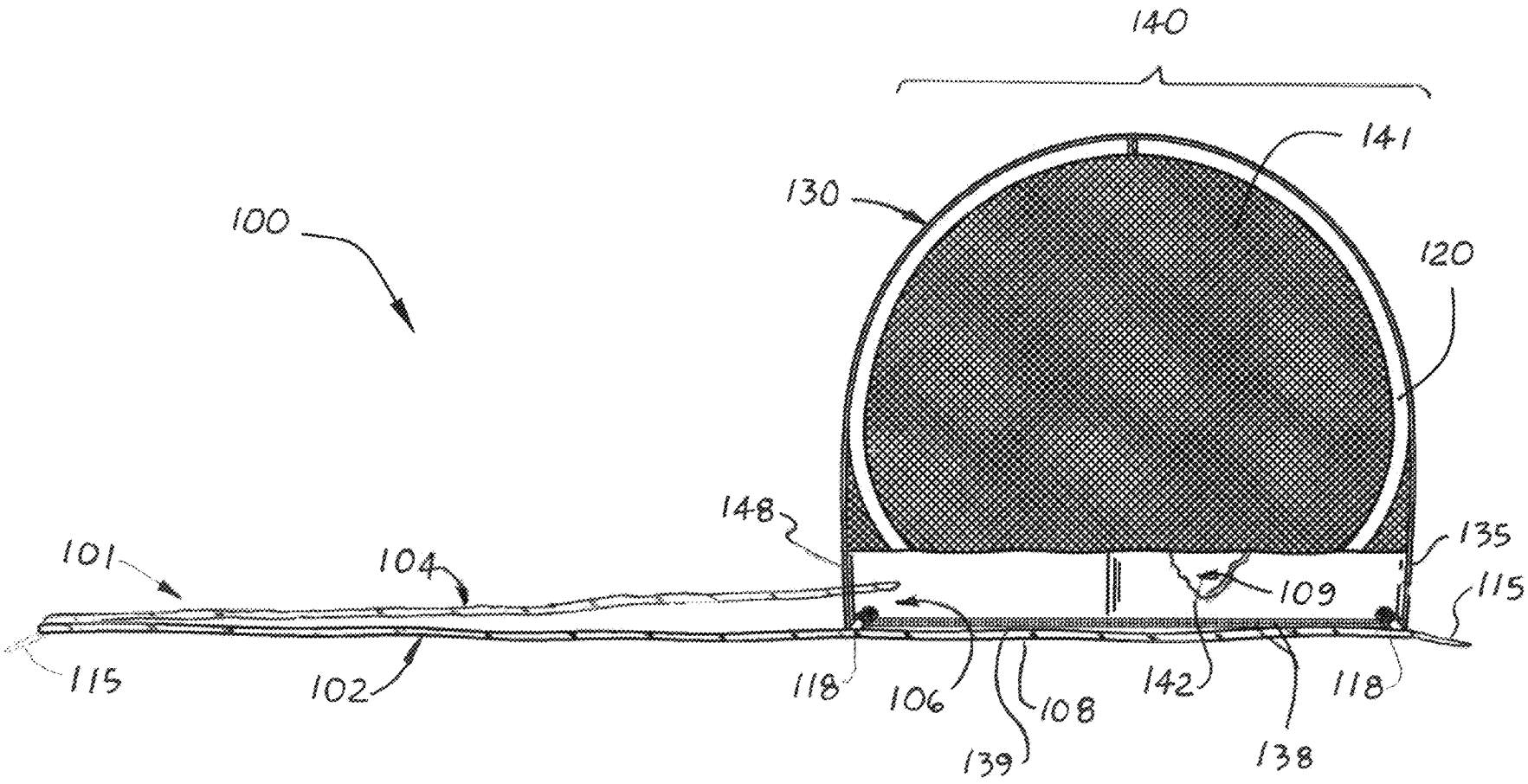
FIG. 5 is a cross-sectional view of the bivouac sack taken along line 5-5, as shown in FIG. 1.
Figure 6:
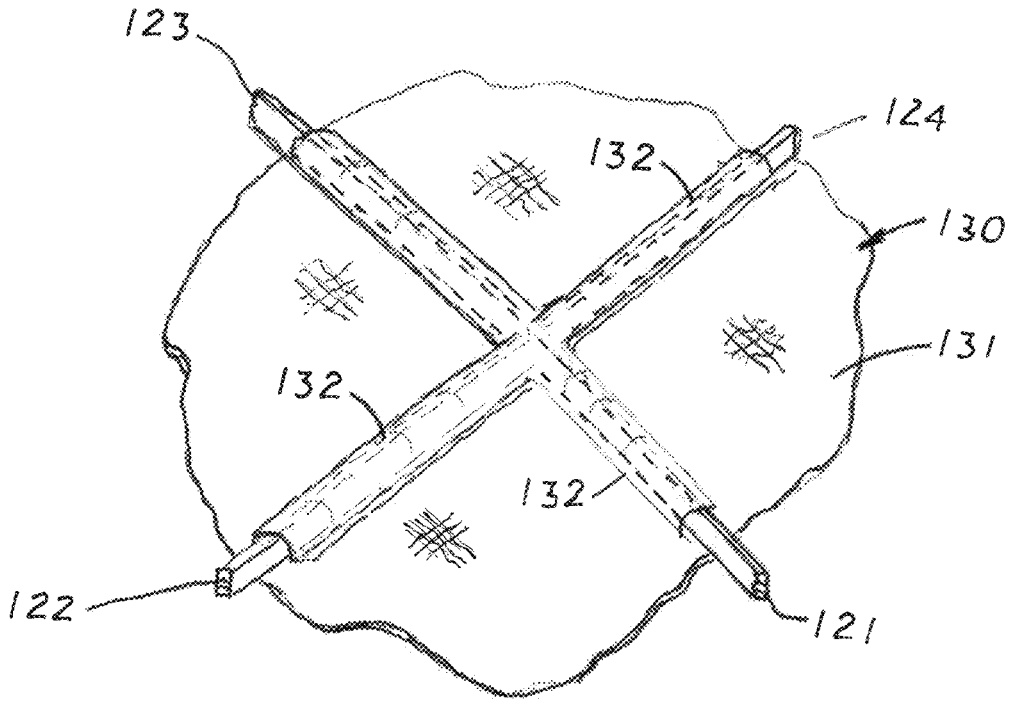
FIG. 6 is a partial perspective view of the inside surface of the cover with frame attachment tubes formed thereon that received shaft sections on the frame.

The bivouac sack 100 comprises a bag shell 101 made of lightweight, waterproof material configured to receive a sleeping bag (not shown). FIGS. 2 and 5 show that bag shell 101 comprises a rectangular ground piece 102 and u top cover 104. The ground piece 102 and top cover 104 are integrally formed or attached along three scaled or closed edges to form a bag structure with a single bag opening 106. The front edge 105 of the top cover 104 is detached from the ground piece 102 and is transversely aligned, forming the bag opening 106.

The ground piece 102 is longer than the top cover 104 and forms a square or rectangular pan 108 that extends beyond the bag opening 106. The ground piece 102 includes a perimeter edge 105 with a plurality of stake loops 115 that receive stakes (not shown) to selectively attach the ground piece 102 to the ground.

When assembled, a self-erecting frame 120 is centrally aligned and assembled over the top surface of pan 108. Frame 120 is configured to fold and collapse with a flexible frame cover 130, discussed further below. When the bivouac sack 100 is deployed, frame 120 is released and automatically expands with frame cover 130 to form a dome 140 over pan 108.

Frame 120 is a long solid multiple loop structure that collapses into a flat circular configuration when forcibly twisted together and automatically expands when released into a figure-eight configuration, as shown in FIG. 2. Frame 120 includes a first torsion shaft section 121, a second torsion shaft section 122, a third torsion shaft section 123, and a fourth torsion shaft section 124 and joined at a center 125.

Disposed over frame 120 is a flexible frame cover 130 configured to create a dome 140 over pan 108. Under the dome 140 is a protected space 109 adjacent to the bag opening 106. Frame cover 130 includes straps or attachment tubes 132 formed on the inside surface 131 that fit around or receive the frame's shaft sections 121, 122, 123, and 124. During use, the shaft sections 121, 122, 123, and 124 can slide freely through the attachment tubes 132, enabling the frame 120 to be forcible collapsed into a circular configuration or when released, expanded into a figure-eight configuration. The frame cover 130 is sufficiently flexible to fold when the frame collapses and expands with the frame 120.

When frame cover 130 is a four-sided, tent-like structure that extends over frame 120, the three lower edges 134, 135, and 136 of frame cover 130 are positioned over the pan 108 adjacent to the pan's three perimeter edges 110, 111, and 112, respectively. A pair of sliding connector strips 138 with interlocking teeth and a slide pull 139 are attached to the pan 108 and the lower edges of the frame cover 130 to selectively attach the pan's three perimeter edges 110, 111, and 112 to frame cover's lower edges 134, 135, and 136, respectively. When the bivouac sack 100 is deployed, the connector strips 138 and slide pull 139 interconnect and hold the perimeter edges 110, 111, 112 and 134, 135, 136, respectively, which enable the frame 120 to expand perpendicularly over pan 108.

Figure 7:
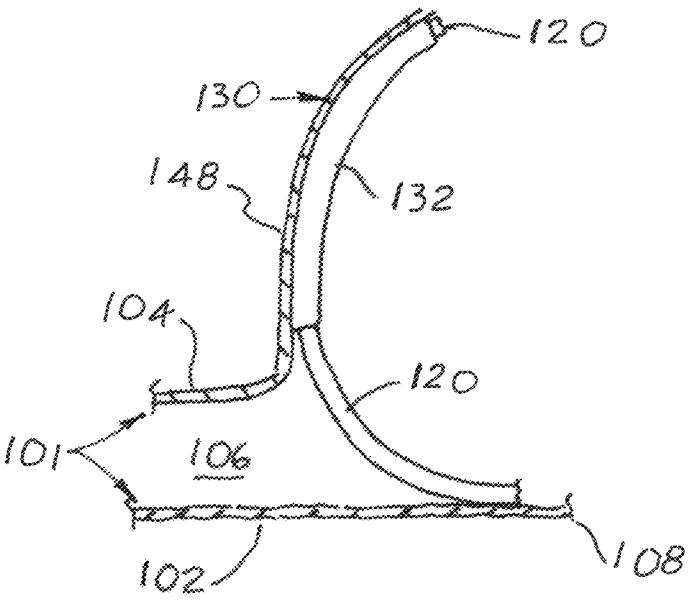
FIG. 7 is a partial side elevation view of the bivouac sack showing the fourth panel of the frame cover integrally formed with top cover of the bag shell.
Figure 8:
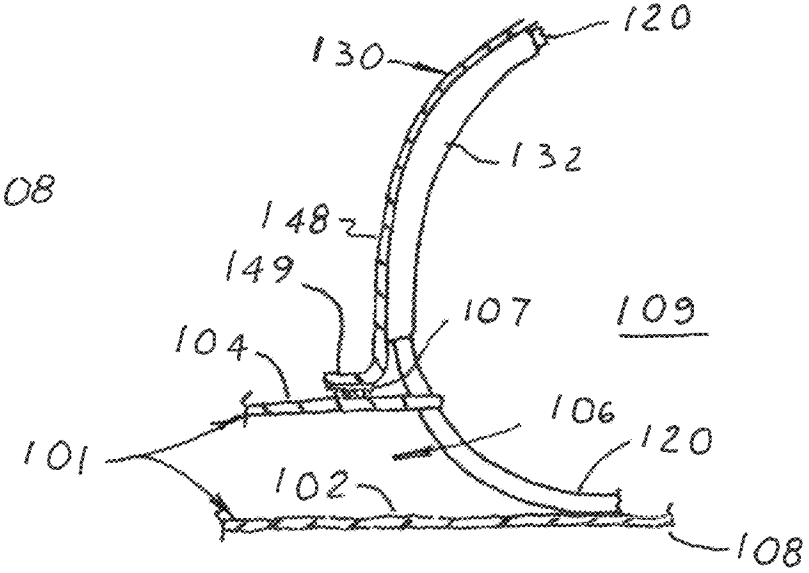
FIG. 8 is a partial side elevation view of the bivouac sack showing the fourth panel of the frame cover being selectively attached to the top cover with a hook and loop connector.

When assembled and deployed, the lower edge 149 of the fourth panel 148 of the frame cover 120 extends downward and transverses the top cover 104. The front edge of the top cover 104 extends into the protected area 109 and forms the bag opening 106. As shown in FIG. 7, the fourth panel 148 of the frame cover 130 may be integrally formed with the top cover 104. As shown in FIG. 8, the lower edge 149 of the fourth panel 148 may be selectively attached to the top cover 104 with hook and loop material 107 (shown in FIG. 8) or buttons (not shown). The ends of the connector strips 138 may partially extend in the fourth panel 148.

FIGS. 1-4 show frame cover 130 with at least one mesh panel 141 that enables the frame cover 130 to act as a bug shield. In the embodiment shown, the mesh panel 141 is centrally located between four reinforcing side panels 142, 144, 146, and 148. The size and shape of the mesh panel 141 and the side panels 142, 144, 146, and 148 may vary. It should be understood that the entire frame cover 130 may be a solid panel or made entirely of mesh material, and the reinforcing side panels 142, 144, 146, and 148 may be eliminated.

Figure 4:
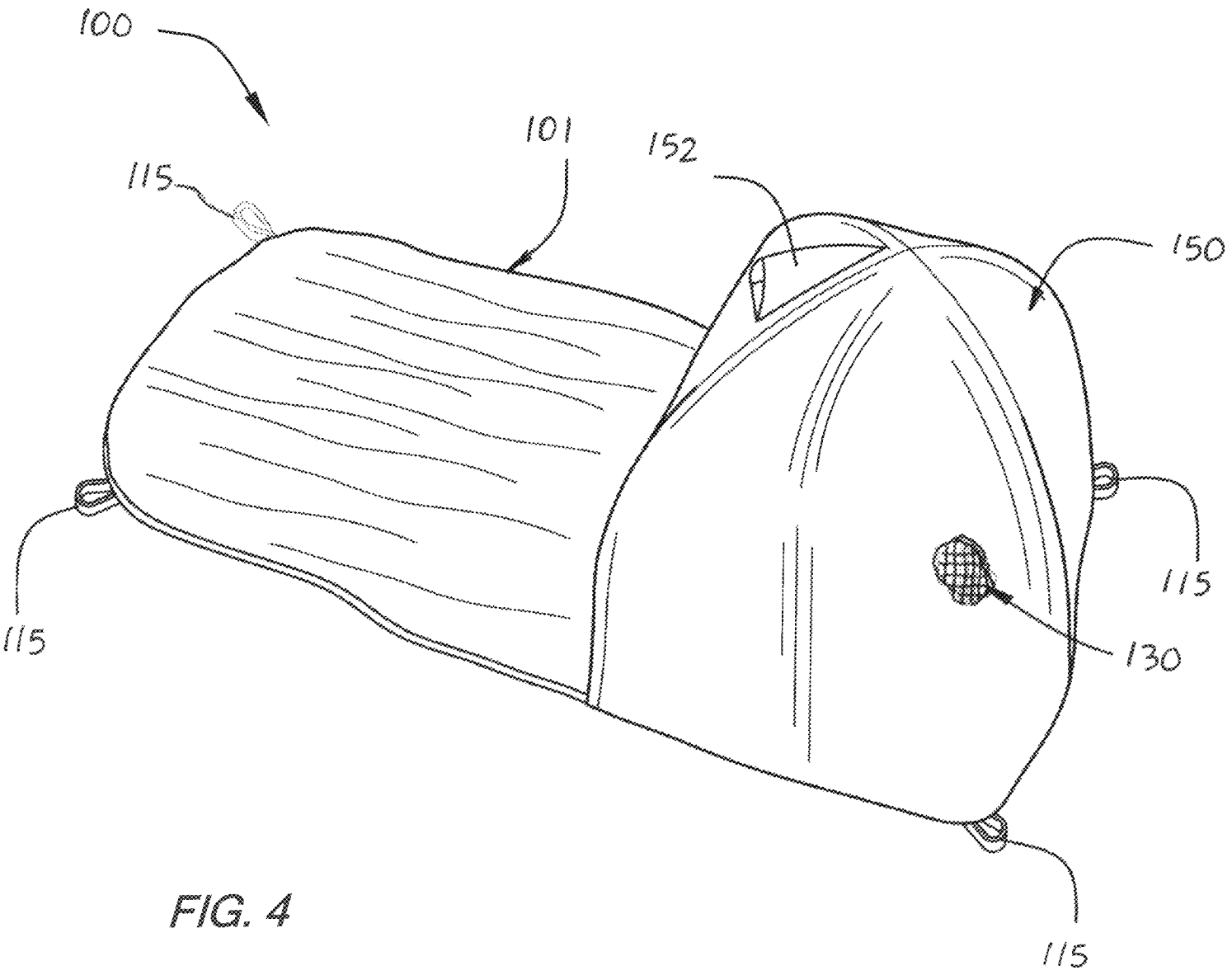
FIG. 4 is a perspective view of the bivouac sack with an outer cover disposed over the pan.

The bivouac sack 100 may also include an optional outer cover 150 that fits over the frame cover 130 when disposed over the frame 120, as shown in FIGS. 2 and 4. The outer cover 150, which may be made of waterproof material and used as a rainfly, is approximately the same size or slightly larger than frame cover 130, enabling it to slide over the frame cover 130 when attached to frame 120. In addition, the outer cover 150 may include an optional vent 152 and buckles 154 that connect to compatible buckles 118 attached to pan 108.

Figure 11:
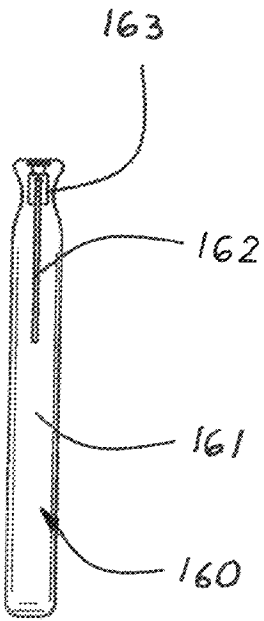
FIG. 11 is a side elevation view of the closed travel bag shown in FIG. 710.
Figure 10:
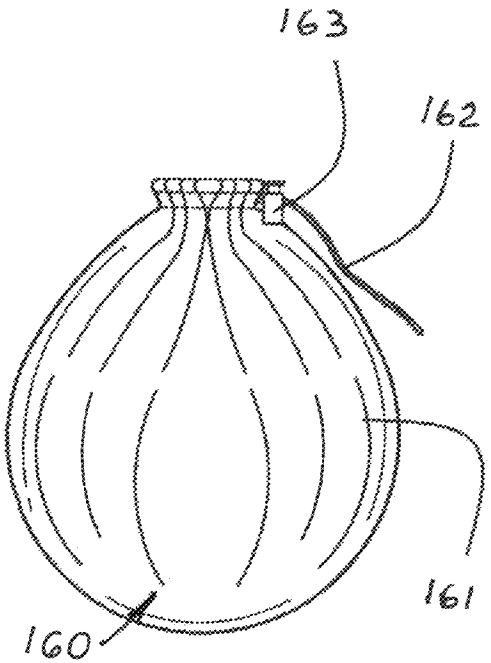
FIG. 10 is a front elevation view of a closed travel bag.
Figure 9:
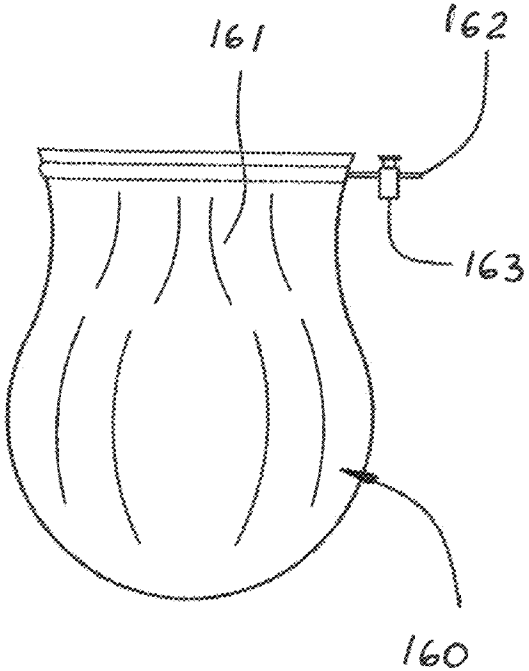
FIG. 9 is a front elevation view of an opened travel bag used to hold the bivouac sack.

The entire bivouac sack 100, when folded into a compact configuration, may be stored in an optional travel bag 160 that includes a carrying sack 161, a drawstring 162, and a cord lock 163. The carrying sack 161, shown in FIGS. 9-11, is a bag sized to receive the folded bag shell 101, the collapsed frame 120 and frame cover 130, and the optional rainfly cover 150. The drawstring 162 is a cord that controls access to the carrying sack 161. The cord lock 163 is a mechanical device that locks drawstring 162 into a fixed position.

Definitions:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bag: As used in this disclosure, a bag is a container made of a flexible material. The bag has a single opening which allows the bag to receive the items to be contained.

Bivouac: As used in this disclosure, a bivouac refers to a portable temporary shelter.

Buckle: As used in this disclosure, a buckle is a fastening device that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Center: As used in this disclosure, a center is a point that is: 1) the point within a circle that is equidistant from all the points or the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar, and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Cord Lock: As used in this disclosure, a cord lock is a device that is used to tighten cords or drawstrings without the use of knots.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. Specifically, the sum of the surface areas of two ends of the prism-shaped object that forms the disk is greater than the surface area of lateral face of the prism-shaped object that forms the disk. In this disclosure, the ends of the prism-shaped structure that forms the disk are referred to as the faces of the disk.

Dome: As used in this disclosure, a dome is a concave structure that forms live superior surface of an object.

Drape: As used in this disclosure, to drape means to cover an object with a sheeting.

Drawstring: As used in this disclosure, a drawstring is a cord, tape, or a webbing that is contained within a channel that is used to fasten or cinch a textile based object such as an item of apparel of a textile covering. Generally, the channel and cord are formed as a single textile component (in the form of a tape that is often marketed commercially "Quick Cord") that is sewn as a single unit into the textile based object after which the cord is released within the channel.

Elastic: As used in this disclosure, an elastic is a material or object that deforms when a force is applied to it and that is able to return to its relaxed shape alter the force is removed. A material that exhibits these qualities is also referred to as an elastomeric material. A material that does not exhibit these qualities is referred to us inelastic or an inelastic material.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners.

Flexible: As used in this disclosure, flexible refers to an object or material that will deform when a force is applied to it, but that will not necessarily return to its original shape when the deforming force is removed.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Framework: As used in this disclosure, a framework refers to the substructure of an object that carries the load path of the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Inferior: As used in this disclosure, the term inferior refers to a directional reference that is parallel to and in the same direction as the force of gravity when an object is positioned or used normally.

Insulating Material: As used in this disclosure, an insulating material is a material that inhibits, and ideally prevents, the transfer of heat through the insulating material. Insulating materials may also be used to inhibit or prevent the transfer of sound or the conduction of electricity through the insulating material. Methods to form insulating materials include, but are not limited to: 1) the use of materials with low thermal conductivity; and, 2) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Monomer: As used in this disclosure, a monomer refers to a molecular structure that bonds to itself in a repeating manner to form a polymer.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with openings that allow for visibility and fluid flow through the structure. Wrought work and meshes are forms of openwork.

Organic: As used in this disclosure, organic refers to a carbon-based chemical structure. A limited number of carbon-based salts are traditionally considered inorganic chemical structures and are excluded from the study of organic chemistry.

Pan: As used in this disclosure, a pan is an open prism-shaped containment structure. The superior structure of the pan is open when the pan is used normally. The superior structure is a horizontal surface selected from the group consisting of: a) an end of the prism structure that forms the pan; and, b) a lateral face of the prism structure that forms the pan.

Perimeter: As used in this disclosure, a perimeter is one or more curved or straight lines that bounds an enclosed area on a plane or surface. The perimeter of a circle is commonly referred to as a circumference.

Plastic: As used in this disclosure, plastic refers to a manufactured material that is formed from a structure selected from the group consisting of a polymer or a copolymer. Unless stated otherwise, this disclosure assumes that the plastic is formed from polymers or similar materials.

Polymer: As used in this disclosure, a polymer refers to a molecular chain that comprises multiple repeating units known as monomers. The repeating unit may be an atom or a molecular structure.

Port: As used in this disclosure, a port is an aperture formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a space formed by a boundary structure. The boundary structure forms a barrier that protects objects within the protected space from potential dangers from the other side of the boundary.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Rectangular Block: As used in this disclosure, a rectangular block refers to a three-dimensional structure comprising six rectangular surfaces (commonly called faces) formed at right angles. Within this disclosure, a rectangular block may further comprise rounded edges and corners.

Relaxed Shape: As used in this disclosure, a structure is considered to be in its relaxed state when no shear, strain, or torsional forces are being applied to the structure.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shaft: As used in this disclosure, a shaft is a long, narrow and rigid prism structure that is used as: 1) a structural element of a larger object; or 2) as a grip or lever for a handle. Shafts often have a cylindrical shape.

Sheeting: As used in this disclosure, a sheeting is a material, such as a paper, textile, a plastic, or a metal foil, in the form of a thin flexible layer or layers.

Shell: As used in this disclosure, a shell if a structure that forms an outer covering intended to contain an object. Shells are often, but not necessarily, rigid or semi-rigid structures that are intended to protect the object contained within it.

Shelter: As used in this disclosure, a shelter is a structure that forms a space used for protection against potentially harmful situations. The term shelter is commonly used for structures that protect against the weather.

Spring: As used in this disclosure, a spring is a device that is used to store mechanical energy. This mechanical energy will often be stored by: 1) deforming an elastomeric material that is used to make the device: 2) the application of a torque to a semi-rigid structure; or 3) a combination of the previous two items.

Stake: As used in this disclosure, a stake is a shaft that is driven into a horizontal surface, such as the ground, to serve as an anchor point.

Textile: As used in this disclosure, a textile is a material that is woven, knitted, braided or felted. Synonyms in common usage for this definition include fabric and cloth.

Torsion: As used in this disclosure, torsion refers to the application of a torque to an object.

Torsion Bar: As used in this disclosure, s torsion bar is a type of torsion spring. The torsion bar is a solid prism-shaped structure that rotates around the center axis formed by the prism structure to store and release mechanical energy.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Zipper: As used in this disclosure, a zipper is a fastening device comprising a first strip, a second strip each with teeth that interlock and a slide head or pull. The two strips when connected form a chain. The chain opened and closed by pulling the slide head over the chain to engage or disengage the teeth.

With respect to the above description, it is to be realized that the optimum dimensional relationship for the various components of the invention described above and in FIGS. 1 through 6C include variations in size, materials, shape, form, function, and manner of operation, assembly and use, are deemed readily apparent and obvious so one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following.ms and their equivalents.

I claim:

1. A bivouac sack, comprising:

a. a bag shell made of lightweight, waterproof material, said bag shell being an elongated structure with a closed end, and an open end opposite said closed end, said bag shell configured to receive a sleeping bag;

b. a pan extending longitudinally from said bag sell adjacent to said open end, said pan includes three perimeter edges;

c. a spring-based, self-deploying frame extending upward from said pan, said frame is a solid loop that collapses into a flat circular configuration when forcibly twisted together and automatically expands when released and automatically expands into a figure-eight configuration that extends over said pan;

d. a flexible frame cover attached to said frame and configured to expand and form a dome when said frame expands into the figure-eight configuration and creates a protected area over said pan; and e. a slide connector used to selectively attach said frame cover to said pan thereby providing an entrance/exit opening into said protected area.

2. The bivouac sack, as recited in claim 1, further including a plurality of stake loops attached to said bag shell and said pan.

3. The bivouac sack, as recited in claim 1, further including a plurality of frame connectors configured to attach said frame cover to said frame.

4. The bivouac sack, as recited in claim 1, wherein said frame cover is at least partially made of mesh material configured to act as a bug shield.

5. The bivouac sack, as recited in claim 1, wherein said frame cover is a solid panel.

6. The bivouac sack, as recited in claim 1, further including an outer cover configured to drape over said frame cover when attached to said frame.

7. The bivouac sack, as recited in claim 6, further including a plurality of connectors that attach said outer cover to said pan when said outer cover is draped over said frame cover when expanded over said frame.

8. A bivouac sack, comprising:

a. bag shell made of lightweight, waterproof material configured to receive a sleeping bag, said bag shell includes an elongated ground piece and to a top cover, said top cover includes a transverse edge detached from said ground piece thereby forming a bag opening into said bag shell, said ground piece includes a perimeter edge and extends longitudinally and beyond said bag opening to form a pan with three perimeter edges;

b. spring-based, self-deploying frame extending upward from said pan said frame is a solid loop that collapses into a flat circular configuration when forcibly twisted together and automatically expands when released into a figure-eight configuration that extend over said pan;

c. a frame cover configured to extend over said frame to make a protected space over said pan, said frame cover includes a plurality of frame attachment elements that connect said frame cover to said frame, said frame cover includes three lower edges that extend downward towards said pan and a fourth lower edge that extends downward and is aligned transversely over said top cover; and d. a zipper disposed along said three lower edges of said frame cover and said three perimeter edges of said pan to selectively attach said frame cover to said pan.

9. The bivouac sack, as recited in claim 8, further including a plurality of stake loops attached to said perimeter edge of said ground piece.

10. A bivouac sack, as recited in claim 8, further including an outer cover that fits over said frame cover when said frame cover is attached to said frame.

11. The bivouac sack, as recited in claim 10, further including a plurality of connectors that attach to said outer cover to said pan.

12. A bivouac sack, comprising:

a. bag shell made of lightweight, waterproof material configured to receive a sleeping bag, said bag shell includes an elongated ground piece and to a top cover, said top cover includes a transverse edge detached from said ground piece thereby forming a bag opening into said bag shell, said ground piece includes a perimeter edge and extends longitudinally and beyond said bag opening to form a pan with three perimeter edges;

b. a spring-based, self-deploying frame extending upward from said pan, said frame is a solid loop that collapses into a flat circular configuration when forcibly twisted together and automatically expands when released into a figure-eight configuration that extends over said pan;

c. a frame cover made of flexible material configured to extend over said frame when said frame is expanded to make a protected space over said pan, said cover includes a plurality of frame attachment tubes that connect to said frame and allows said frame to expand and collapse, said cover includes three lower edges that extend downward and attach to said pan and a fourth lower edge that extends downward and is aligned transversely over said top cover of said bag shell;

d. a pair of sliding connecting strips, one said sliding connecting strip being attached to said three perimeter edges of said pan and one sliding connecting strip being attached to said three lower edges of said frame cover; and;

e. a slide pull used to selectively interconnect said sliding connector strip attached to said pan and said slide connector strip attached to said frame cover to provide ingress and egress to said protected area under said frame and said frame cover.

13. The bivouac sack, as recited in claim 12, further including an outer cover disposed over said frame cover when said frame cover is attached to said frame.

14. The bivouac sack, as recited in claim 13, wherein said outer cover is made of waterproof material.

15. The bivouac sack, as recited in claim 14, further including a vent formed on said outer cover.

16. The bivouac sack, as recited in claim 13 further including connectors that selectively attach said outer cover to said pan.

17. The bivouac sack, as recited in claim 16, further including a vent formed on said outer cover.

18. The bivouac sack, as recited in claim 12, wherein said cover is a bug shield.

* * * * *